US007900803B2

(12) United States Patent
Hafner

(10) Patent No.: US 7,900,803 B2
(45) Date of Patent: Mar. 8, 2011

(54) APPARATUS FOR THE INTERMITTENT SUPPLY OF A SEMI-FINISHED MATERIAL IN THE FORM OF A BAND OR A WIRE TO A PRESS

(75) Inventor: Josef Thomas Hafner, Rorschacherberg (CH)

(73) Assignee: Bruderer AG (CH)

( * ) Notice: Subject to any disclaimer, the term of this patent is extended or adjusted under 35 U.S.C. 154(b) by 0 days.

(21) Appl. No.: 12/005,658

(22) Filed: Dec. 27, 2007

(65) Prior Publication Data

US 2008/0164294 A1 Jul. 10, 2008

(30) Foreign Application Priority Data

Jan. 8, 2007 (EP) ..... 07000213

(51) Int. Cl.
*B65H 23/06* (2006.01)

(52) U.S. Cl. ..... 226/149; 226/151; 226/161

(58) Field of Classification Search ..... 226/149, 226/151, 161, 162, 167
See application file for complete search history.

(56) References Cited

U.S. PATENT DOCUMENTS 3,200,686 A 8/1965 Norton et al.
3,401,580 A * 9/1968 Sigg ..... 475/344

(Continued)

FOREIGN PATENT DOCUMENTS

CH 543 932 12/1973

(Continued)

OTHER PUBLICATIONS

Esp@cenet Abstract of DE 32 22 128 dated Dec. 15, 1983.

(Continued)

*Primary Examiner*—Evan H Langdon
(74) *Attorney, Agent, or Firm*—McCormick, Paulding & Huber LLP

(57) ABSTRACT

The invention relates to an advancing apparatus for the intermittent supply of a semi-finished material (22) in the form of a band to a press. The apparatus comprises a pair of displacement grippers (4, 7) which run forwards and backwards and by which the material (22) is advanced in an advancing phase, a stationary pair of clamping grippers (24, 27) by which the material (22) is held in a fixed manner in a non-advancing phase, and a control rocker (12) with a control drive (40, 42) which is coupled to one control end of the latter and to which the pair of displacement grippers (4, 7) and the pair of clamping grippers (24, 27) are coupled mechanically and their interaction is controlled. In this case the control rocker (12), the pair of clamping grippers (24, 27) and the pair of displacement grippers (4, 7) are designed and are coupled to one another in such a way that in the absence of a supporting or actuating force exerted by the rocker drive (40, 42) upon the control end of the control rocker (12) both the pair of clamping grippers (24, 27) and the pair of displacement grippers (4, 7) are closed.

Figure 1:
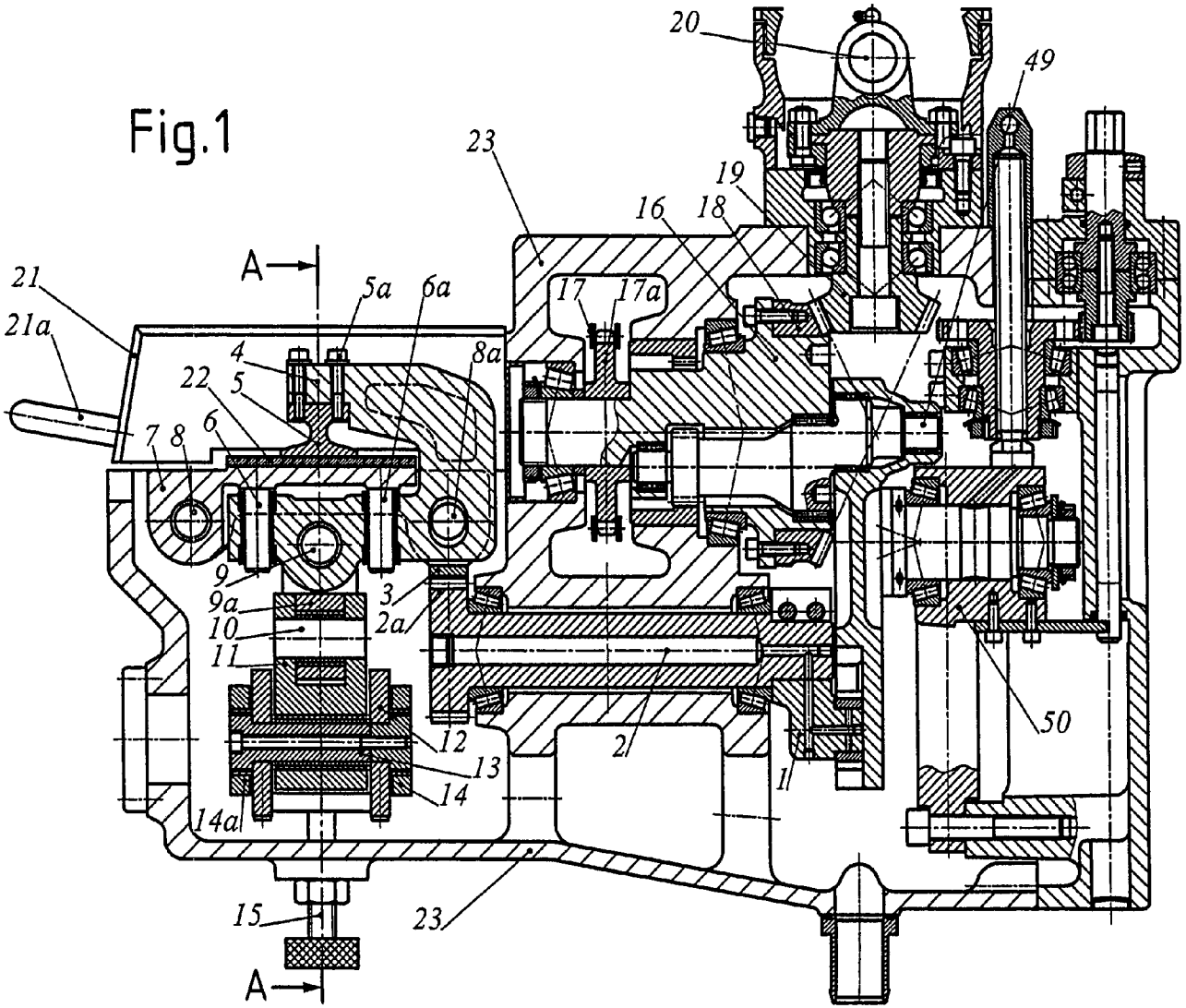

On account of the design, according to the invention, of the system comprising the control rocker, the pair of clamping grippers and the pair of displacement grippers it becomes possible to make gripper-advancing apparatus available which can permit high advancing frequencies and which are highly durable.

21 Claims, 3 Drawing Sheets

U.S. PATENT DOCUMENTS

| | | | | | |
|---|---|---|---|---|---|
| 3,758,011 | A | | 9/1973 | Portmann | |
| 4,552,294 | A | | 11/1985 | Rotzler | |
| 4,776,505 | A | * | 10/1988 | Kato | 226/152 |
| 4,792,074 | A | * | 12/1988 | Bareis et al. | 226/149 |
| 4,819,850 | A | * | 4/1989 | Kato | 226/162 |
| 4,883,210 | A | | 11/1989 | Kato | |
| 5,163,595 | A | * | 11/1992 | Messner | 226/154 |
| 5,358,164 | A | * | 10/1994 | Messner | 226/142 |
| 5,632,430 | A | | 5/1997 | Katp | |
| 6,213,369 | B1 | | 4/2001 | Kato | |
| 6,283,352 | B1 | | 9/2001 | Messner et al. | |
| 6,662,988 | B2 | | 12/2003 | Eigenmann | |
| 7,229,380 | B2 | | 6/2007 | Kato | |

FOREIGN PATENT DOCUMENTS

| | | |
|---|---|---|
| CH | 544 243 | 12/1973 |
| DE | 26 59 156 | 7/1978 |
| DE | 32 22 128 | 12/1983 |
| DE | 32 47 001 | 6/1984 |
| DE | 33 11 520 | 10/1984 |
| DE | 34 06 483 | 8/1985 |
| DE | 37 31 863 | 4/1988 |
| DE | 39 25 485 | 3/1990 |
| DE | 195 26 064 | 9/1996 |
| DE | 199 51 547 | 6/2000 |
| EP | 1 002 596 | 5/2000 |
| EP | 1 598 125 | 11/2005 |
| EP | 1 640 084 | 4/2007 |
| GB | 1 405 774 | 9/1975 |
| JP | 9-38738 | 2/1997 |
| JP | 9-38739 | 2/1997 |
| JP | 11-10260 | 1/1999 |
| JP | 2001-300653 | 10/2001 |
| JP | 2003-285130 | 10/2003 |
| JP | 2004-58072 | 2/2004 |
| JP | 2004-141928 | 5/2004 |
| JP | 2005-21904 | 1/2005 |
| JP | 2005-138131 | 6/2005 |
| JP | 2005-313192 | 11/2005 |
| JP | 2005-319478 | 11/2005 |
| JP | 2006-15384 | 1/2006 |
| JP | 2006-105193 | 4/2006 |
| WO | 99/65627 | 12/1999 |

OTHER PUBLICATIONS

Esp@cenet Abstract of DE 33 11 520 dated Oct. 25, 1984.
Esp@cenet Abstract of DE 34 06 483 dated Aug. 29, 1985.
Esp@cenet Abstract of DE 39 25 485 dated Mar. 22, 1990.
Esp@cenet Abstract of EP 1 640 084 dated Mar. 29, 2006.
Patent Abstracts of Japan of JP 11-010260 dated Jan. 19, 1999.
Patent Abstracts of Japan of JP 2001-300663 dated Oct. 30, 2001.
Patent Abstracts of Japan of JP 2003-285130 dated Oct. 7, 2003.
Patent Abstracts of Japan of JP 2004-141928 dated May 20, 2004.
Patent Abstracts of Japan of JP 2005-021904 dated Jan. 27, 2005.
Patent Abstracts of Japan of JP 2005-138131 dated Jun. 2, 2005.
Patent Abstracts of Japan of JP 2005-313192 dated Nov. 10, 2005.
Patent Abstracts of Japan of JP 2005-319478 dated Nov. 17, 2005.
Patent Abstracts of Japan of JP 2006-015384 dated Jan. 19, 2006.
Patent Abstracts of Japan of JP 09-038739 dated Feb. 10, 1997.
Patent Abstracts of Japan of JP 2004-058072 dated Feb. 26, 2004.
Esp@cenet Abstract of WO 99/65627 dated Dec. 23, 1999.
Patent Abstracts of Japan of JP 9-38738 dated Feb. 10, 1997.

* cited by examiner

APPARATUS FOR THE INTERMITTENT SUPPLY OF A SEMI-FINISHED MATERIAL IN THE FORM OF A BAND OR A WIRE TO A PRESS

The present invention relates to an apparatus for the intermittent supply of a semi-finished material in the form of a band or a wire to a press.

In the industrial production of small pressed and punched parts, use is made today of high-speed presses to which a semi-finished material in the form of a band or a wire is supplied intermittently by means of a synchronized supply apparatus. For advancing purposes the semi-finished material is clamped in the supply apparatus between two rollers or in a pair of displacement grippers and it is advanced by a rotational movement of the rollers in opposite directions with a specified rotational angle or a linear movement of the pair of displacement grippers. After each advance, the clamping of the semi-finished material between the rollers or in the pair of displacement grippers is discontinued in each case and the rollers or the pair of displacement grippers are set back again to the starting situation, in which case the semi-finished material is clamped in a fixed manner with a clamping guide or a pair of clamping grippers. After that, the next advancing procedure is carried out, optionally after performing an additional intermediate lifting step in which the semi-finished material is released for a short time in the supply apparatus in order to permit an exact positioning of the said material by means of a positioning member in the press.

Whilst the roller-type advancing apparatus known at present have the advantage that they are relatively compact, inexpensive and robust and, in addition, are suitable for relatively high advancing frequencies, they have the major drawback, however, that they are not suitable for sensitive semi-finished materials, since the latter are subjected to a tremendous contact pressing during the advance with the rollers as a result of the linear contact face, and this leads almost inevitably to marks and scratches.

In contrast, the gripper-type advancing apparatus known today are ideally suitable for the processing of very sensitive semi-finished materials, since during the advance the latter is not rolled over but is clamped only at individual locations on relatively large areas in the grippers, so that contact between the advancing member and the semi-finished product occurs only locally and, in addition, significantly lower surface pressing takes place. The crucial drawback of the gripper-type advancing devices known at present, however, is that they allow only relatively low advancing frequencies.

The object of the invention is therefore to make available a gripper-type advancing apparatus which allows advancing frequencies similar to a comparable roller-type advancing apparatus and which thus combines the advantages of these two concepts of advancing with each other.

This object is attained by the advancing apparatus according to claim 1.

Accordingly, the apparatus according to the invention for the intermittent supply of a semi-finished material in the form of a band or a wire to a press comprises a pair of displacement grippers which run forwards and backwards, preferably in a linear manner, during operation and by which the semi-finished material is advanced in an advancing phase. In addition, the apparatus comprises a stationary pair of clamping grippers by which the semi-finished material is held in a fixed manner in a non-advancing phase, i.e. in a phase in which the semi-finished product is at a standstill. In addition, the apparatus comprises a control rocker with a rocker drive coupled to one control end of the said control rocker. The pair of displacement grippers and the pair of clamping grippers are coupled mechanically to the control rocker in such a way that during operation they can be opened and closed in an alternating manner by the reciprocating movement of a control end of the control rocker with the rocker drive, in order to allow the semi-finished material to be alternately advanced and held in a fixed manner with the apparatus. In this case the control rocker, the pair of clamping grippers and the pair of displacement grippers are designed and are coupled to one another in such a way that in the absence of a supporting or actuating force exerted by the rocker drive upon the control end of the control rocker both the pair of clamping grippers and the pair of displacement grippers are closed, i.e. in order to produce a situation in which the two pairs of grippers are closed there should not be an introduction of force through the rocker drive into the control end of the control rocker and in order to produce this state there should not be an introduction of force from the rocker drive into the control end. In other words, the system comprising the control rocker, the pair of clamping grippers and the pair of displacement grippers is thus designed in such a way that when the control end is cut free from the rocker drive the two pairs of grippers would be closed or would be kept closed exclusively by the weight of the system comprising the control rocker, the pair of clamping grippers and the pair of displacement grippers and/or by spring forces acting upon the said system.

On account of the design, according to the invention, of the system comprising the control rocker, the pair of clamping grippers and the pair of displacement grippers, it becomes possible to make gripper-feeding apparatus available which can be operated at substantially higher advancing frequencies than could be achieved hitherto. In addition, particularly durable designs are possible as a result, since in the case of the advancing apparatus according to the invention the direction of force in the drive system for the control rocker changes, so that in the preferred embodiment of the latter with journal bearings an optimum supply of lubricant to the sliding faces is provided as a result of the change of play.

In a preferred embodiment of the apparatus, the two pairs of grippers are coupled to the control rocker at points spaced apart from one another as viewed in a direction trans-verse to the pivot axis of the control rocker, the coupling point of the pair of displacement grippers to the control rocker being situated between the coupling point of the pair of clamping grippers and the control end of the control rocker, and preferably centrally between them. This results in the advantage that the clamping force of the pair of displacement grippers is greater in the advancing phase than the clamping force of the pair of clamping grippers in the non-advancing phase, which is preferred since the pair of displacement grippers must additionally overcome the mass inertia of the semi-finished material to be advanced as well as frictional forces.

In a further preferred embodiment, the apparatus is designed in such a way that the clamping grippers and the displacement grippers can be opened and closed in an alternating manner by an upward and downward movement of the control end of the control rocker with the rocker drive. This results in the advantage that a simple coupling between the grippers and the control rocker becomes possible and the weight of the control rocker and the coupling members can be utilized in order to close the grippers.

In yet a further preferred embodiment of the apparatus, one or more pre-stressed spring elements, preferably one or more pre-stressed compression springs and/or tensile springs, engage on the control rocker, in such a way that a closing of the pairs of grippers is assisted by the spring force of the said spring elements. As a result, in order to close the grippers by the rocker drive, at most low additional actuating forces are required in order to overcome forces of inertia, and this promotes a rapid closure during operation and, in addition, makes it possible to set the clamping forces of the grippers within narrow limits.

In this case it is preferable for the pair of clamping grippers and the pair of displacement grippers to be coupled to the control rocker at points spaced apart from one another as viewed in a direction transverse to the pivot axis of the control rocker, and for the force-engagement point of the spring element or, in the case of a plurality of spring elements, the resulting force-engagement point of the spring elements to be situated, in particular, centrally in the region between the two coupling points of the pairs of grippers, so that a substantially balanced distribution of the spring force to the two pairs of grippers results.

In yet a further preferred embodiment of the apparatus, the pair of clamping grippers and the pair of displacement grippers have in each case an upper half of the grippers and a lower half of the grippers which are movable towards each other in order to close the pairs of grippers and are movable away from each other in order to open the pairs of grippers. In this case, the lower half of the grippers is designed so as to be non-movable in the closing direction and the upper half of the grippers is designed so as to be movable in the closing direction in each case, and this provides the advantage that it is possible to set the thickness of the band or wire in a simple manner since the clamping face of the lower half of the grippers can be kept practically in alignment with the face of the supply bench for all thicknesses.

In yet a further preferred embodiment, the pair of clamping grippers and the pair of displacement grippers of the apparatus have in each case one half of the grippers which is non-movable in the closing direction and one half of the grippers which is movable in the closing direction. In this case the movable halves of the pairs of grippers are coupled in each case to the control rocker in such a way that during the opening and closing of the respective pair of grippers the control rocker performs a movement in substantially the same direction as the opening and closing movement of the movable half of the grippers in the region of the coupling point of the said pair of grippers, i.e. for example when the movable half of the grippers is raised the control rocker is likewise raised and when the latter is lowered the control rocker is likewise lowered. As a result, designs are possible in which the pair of clamping grippers and the pair of displacement grippers are coupled to the control rocker by way of a single connecting rod in each case, and this is preferred, since this results in a direct coupling and unnecessary moved parts, which cause additional costs, mass inertia and play, are omitted.

In yet a further preferred embodiment of the apparatus, in order to carry out the reciprocating movement of the control end of the control rocker, the rocker drive is designed in such a way that it can transmit actuating forces both in the loading direction and in the releasing direction. It is preferably constructed in the form of a connecting-rod or eccentric drive. It is possible to achieve high advancing frequencies with drives of this type, since, in the event that the release movement is not produced by weight and/or spring forces in the required time due to mass inertia, the said release movement is constrained by the rocker drive.

In yet a further preferred embodiment of the apparatus, the control rocker is connected by way of a connecting rod to a component which is fix with respect to the apparatus, so that the said control rocker, in combination with the coupling points to the pair of clamping grippers and to the pair of displacement grippers, occupies precisely defined positions with respect to the housing during operation. If the coupling point of the connecting rod on the control rocker coincides with the coupling point of one of the two pairs of grippers, which is preferred, this provides the advantage that a common coupling point can be formed, and this saves production costs and available space. In this case the coupling point of the connecting rod advantageously coincides with the coupling point of one of the two pairs of grippers which is nearest to the control end of the control rocker, since, as a result, designs are possible in which a satisfactory compromise is achieved between as large as possible a length of the connecting rod, which is desirable from a kinematic viewpoint (as small as possible an angle of rotation at the mounting points in order to minimize the horizontal movement of the control rocker), and as short as possible a length of the connecting rod, which is desirable from the viewpoint of the mounting (as large as possible an angle of rotation at the bearing points in order to prevent damage to the bearings), without an unnecessary enlargement of the structural dimensions.

In yet a further preferred embodiment of the apparatus, all the force-introduction points into the control rocker, or in the case of a plurality of introduction points for the same force the respective resulting force-introduction points, are situated in a plane which is at a right angle to a pivot axis of the control rocker, so that the rocker is free of torsional moment during operation. In this case it is preferred that the plane, in which the force-introduction points are situated, extends through the longitudinal axis of a semi-finished material which is to be advanced by the apparatus during operation. As a result of these steps, a maximum degree of precision and a long service life can be achieved.

Figure 2:
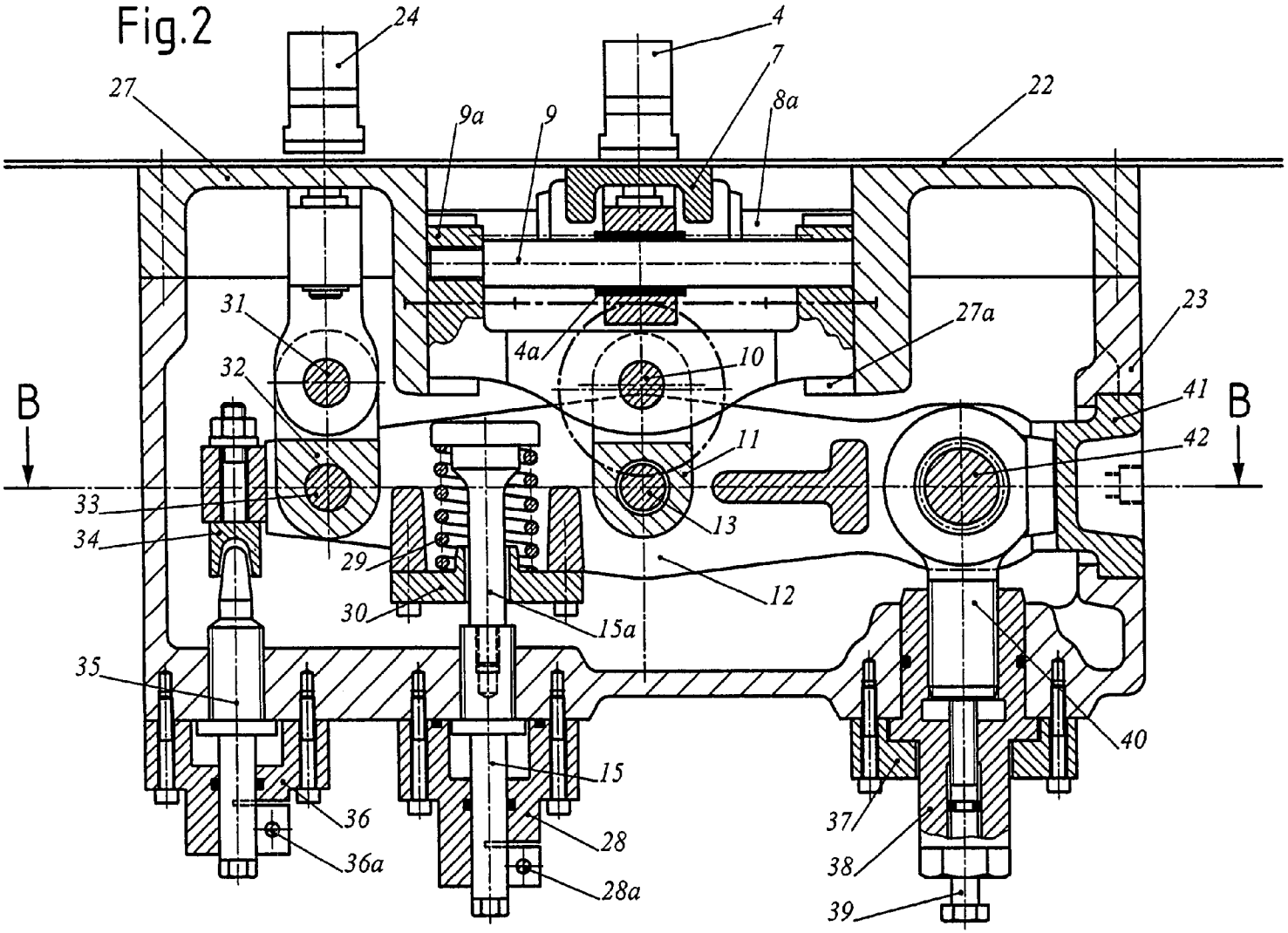
Figure 3:
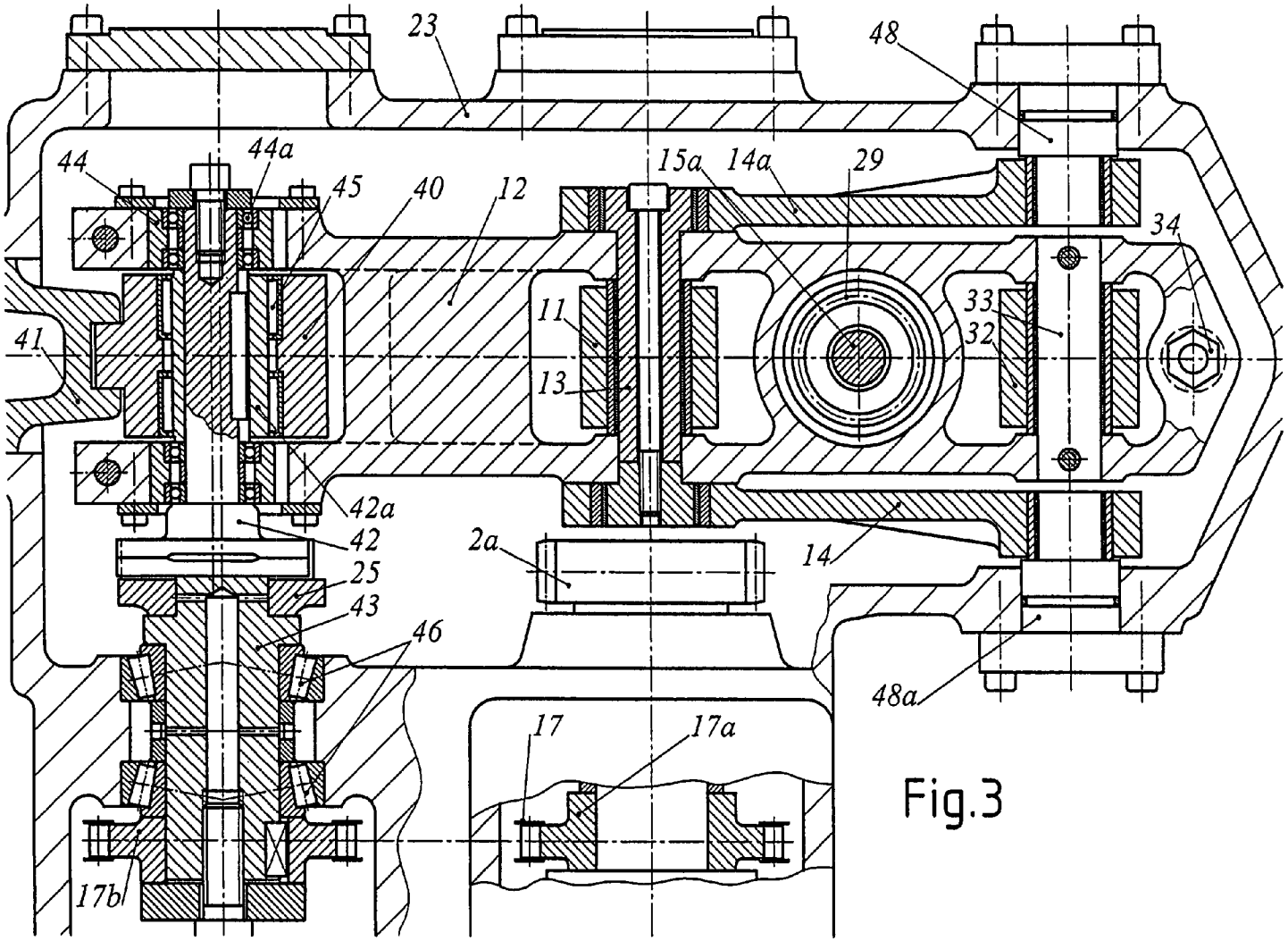

Further preferred embodiments of the invention are set out in the dependent claims and in the description now following, with reference to the drawings. In the drawings FIG. 1 is a longitudinal section through an advancing apparatus according to the invention;

FIG. 2 is a section through the advancing apparatus along the line A-A in FIG. 1, and FIG. 3 is a section through the advancing apparatus along the line B-B in FIG. 2.

FIG. 1 is a longitudinal section through a gripper-type advancing apparatus according to the invention for the intermittent supply of a band-like material 22 to a blanking press (not shown). The advancing apparatus comprises a pair of displacement grippers 4, 7 running forwards and backwards during operation for advancing the semi-finished material 22 in an advancing phase, a pair of clamping grippers 24, 27—situated behind the pair of displacement grippers 4, 7 in the illustration in FIG. 1 and therefore visible only in FIG. 2—for holding the semi-finished material 22 in a fixed manner during an operating phase in which no advancing movement takes place, and a control rocker 12 to which the pair of displacement grippers 4, 7 and the pair of clamping grippers 24, 27 are coupled mechanically and by means of which the interaction of the pair of displacement grippers and the pair of clamping grippers is controlled, as one end of the said control rocker 12—the control end of the control rocker 12 according to the claims—is moved up and down by means of an eccentric drive 40, 42, 42*a*, 44, 45 during operation (see FIG. 3). The driving energy for the advancing apparatus is supplied from the blanking press by way of a universal-joint shaft 20. Instead of the said universal-joint shaft 20, it would also be possible for a drive motor, preferably a servo-motor, to provide the driving energy. As is evident, the rotational movement of the universal-joint shaft 20 is deflected onto a main shaft 16 by a pinion 19 and a toothed wheel 18. A special crank mechanism in the main shaft 16 produces a purely horizontal movement on a pin 49 from it, the said horizontal movement being converted by way of a vertically displaceable bearing 50 into a continuously adjustable incremental angle on a guide member 1. The said incremental angle is then transmitted to a shaft 2 with a spur gearing 2*a* and after that it is converted by way of a gear rod 3 into a longitudinal movement of the pair of displacement grippers 4, 7. The band 22 to be conveyed is pressed onto the lower half 7 of the pair of displacement grippers 4, 7 by a clamping shoe 5 which is formed by the upper half 4 of the grippers and which is fastened by screws 5*a* and is therefore interchangeable. The frictional connexion between the pair of displacement grippers 4, 7 and the band material 22, which is necessary for advancing purposes, is produced in this way.

As is evident from a study of FIG. 2, which shows a section along the line A-A in FIG. 1 through the gripper-type advancing apparatus, a spring 29 supported on a collar stud 15*a* exerts a pressing force directed vertically downwards upon the control rocker 12 by way of a cover 30. In the situation illustrated, in which the pair of clamping grippers 24, 27 is opened and the pair of displacement grippers 4, 7 is closed so as to clamp the band 22, this force is passed on by way of a pin 13 to a guide member 11 and by way of a further pin 10 to a yoke 9*a* with a guide rod 9 fitted therein. The upper half 4 of the pair of displacement grippers 4, 7 is guided in a vertically movable manner on pins 6, 6*a* and is acted upon with the spring force by the guide rod 9 by way of a bushing 4*a*. The lower half 7 of the pair of displacement grippers 4, 7 is guided in a horizontally movable manner by four bearing bushes 7*a* on guide rods 8, 8*a* and carries the pins 6, 6*a*.

As is evident from a study of FIG. 3, which shows a section through the gripper-type advancing apparatus along the line B-B in FIG. 2, the control rocker 12 is held in position by two connecting rods 14, 14*a* by way of the ends of the pin 13. The connecting rods 14, 14*a* in turn are supported in the housing 23 of the advancing apparatus by way of axle bolts 48, 48*a*. In this way, the control rocker 12 is variable vertically, this being necessary for the ability of the advancing apparatus to be set to different thicknesses of the band and a possible intermediate lifting operation.

The pre-stressing force of the spring 29 can be adjusted with a rotary knob 15. A flange 28 limits the end positions possible, and an unintended change of the force is prevented in normal advancing operation by a clamping mechanism 28*a*.

The control rocker 12 has to be set in a swinging motion in order that the pair of displacement grippers 4, 7 and the pair of clamping grippers 24, 27 may be opened and closed in an alternating manner for the band material 22 to be alternately advanced and held in a fixed manner. To this end, the rotational movement of the main shaft 16 is transmitted by way of two sprocket wheels 17*a*, 17*b* and a chain 17 to a shaft 43 which is coupled by way of a so-called Oldham coupling to a rocker-drive shaft 42. An offsetting of the axes of rotation of the shafts 42, 43 with respect to each other is made possible by the Oldham coupling. An eccentric bush 42*a*, which produces a lifting movement of the control end of the control rocker 12 during the rotation of the rocker-drive shaft 42, is mounted on the said rocker-drive shaft 42 which is mounted with slide blocks 44 with ball bearings 44*a* in the control end of the control rocker 12. The eccentric bush 42*a* is mounted with two needle bearings 45 in the head of a displacement spindle 40. The slide blocks 44 are guided in horizontal slots in the control end of the control rocker 12 and, in this way, have the degree of freedom required. The spindle 40 can be displaced upwards or downwards in order to set the apparatus to different thicknesses of the band material 22 to be advanced, in that a spindle nut 38 mounted in a flange 37 is turned after a securing screw 39 has been loosened. In order to prevent the spindle 40 from turning during this, a guide element 41 is provided in which the head of the spindle 40 is guided in a vertically displaceable manner in a slot.

The entire rocker drive and the control rocker 12 with all their associated mechanisms are arranged in the housing 23 of the advancing apparatus. The pair of displacement grippers 4, 7 is fitted in the housing cover 27. The yoke 9*a* is guided in a special guide 27*a*. The cover 27 is connected by screws 27*b* to the housing 23. The play between the gear rod 3 and the pinion 2*a* can also be set or minimized respectively by this connection.

The pair of clamping grippers 24, 27 has substantially the same design as the pair of displacement grippers 4, 7. In this case, too, the upper half 24 of the grippers is guided in a vertically movable manner on pins (not shown). The said pins, however, are screwed directly into the cover 27 which is fixed with respect to the apparatus and which at the same time forms the lower, fixed half 27 of the grippers. In addition, in this case, too, a guide member 32 connects the upper half 24 of the grippers to the control rocker 12 by way of two bolts 31, 33.

As becomes evident from a detailed observation, in this case the system comprising the pair of clamping grippers, the pair of displacement grippers and the control rocker is designed according to the invention in such a way that a state in which the two pairs of grippers 4, 7, 24, 27 are closed at the same time can occur only when no forces are introduced by the rocker drive 40, 42, 42*a*, 44, 45 into the control end of the control rocker 12, i.e. neither supporting or actuating forces directed in a direction vertically upwards nor supporting or actuating forces directed in a direction vertically downwards are introduced into the control end of the control rocker 12. On account of the bearings 44 guided in horizontal slots in the control end, it is not possible for horizontal forces to be transmitted at all.

As is evident from FIG. 2, the end of the control rocker 12 opposite the control end has a stop element 34. If the control rocker 12 arrives at a specified point in the vicinity of the lower dead centre of the press, then the stop element 34, if the advancing apparatus is operated in the intermediate lifting operation, will contact a spindle 35, as a result of which the pair of clamping grippers 24, 27 will be released and the band material 22 will be freed, so that the latter can be orientated by means of a catching pin in the tool of the press. The moment or the start of this brief release of the band material—referred to as the intermediate lifting—in the vicinity of the lower dead centre of the press is capable of being set by the spindle 35 in a continuous manner. In addition, the spindle 35 can be set in such a way that no intermediate lifting takes place. In this case, too, a flange 36 bounds the possible end positions of the spindle 35, and an unintended change of the latter can be prevented by a clamping mechanism 36*a*.

The invention claimed is:

1. An apparatus for intermittently supplying a semi-finished material in the form of a band or a wire to a press, the apparatus comprising:

a pair of displacement grippers, running forwards and backwards during operation, for advancing the semi-finished material in an advancing phase, a stationary pair of clamping grippers for holding the semi-finished material in a fixed manner in a non-advancing phase, and a control rocker with a rocker drive coupled to one control end of the control rocker, wherein the pair of displacement grippers and the pair of clamping grippers are coupled mechanically to the control rocker such that during operation, the two pairs of grippers open and close in an alternating manner by reciprocating the control end of the control rocker with the rocker drive to alternately advance and hold the semi-finished material in a fixed manner, wherein the control rocker and the two pairs of grippers are arranged and coupled to one another such that in the absence of a force exerted by the rocker drive upon the control end of the control rocker the two pairs of grippers are maintained in a closed position.

2. An apparatus according to claim 1, wherein the two pairs of grippers are coupled to the control rocker at coupling points spaced apart from one another as viewed in a direction transverse to the control rocker, and the coupling point of the pair of displacement grippers to the control rocker is situated centrally between the coupling point of the pair of clamping grippers and the control end of the control rocker.

3. An apparatus according to claim 1, wherein the two pairs of grippers are disposed with respect to the control rocker so as to open and close in the alternating manner during operation by an upward and downward movement of the control end of the control rocker.

4. An apparatus according to claim 1, further comprising one or more pre-stressed spring elements engaging the control rocker such that a closing of the pairs of grippers is assisted by a spring force of the one or more spring elements.

5. An apparatus according to claim 4, wherein the two pairs of grippers are coupled to the control rocker at points spaced apart from one another as viewed in a direction transverse to the control rocker, and a force-engagement point of the spring element on the control rocker or, in the case of a plurality of spring elements, the resulting force-engagement point on the control rocker is situated, in particular, centrally in the region between the two coupling points of the pairs of grippers.

6. An apparatus according to claim 1, wherein the two pairs of grippers each have an upper half and a lower half movable towards each other in order to close the pairs of grippers and are movable away from each other in order to open the pairs of grippers, wherein the lower half of the grippers is arranged so as to be non-movable in the closing direction and the upper half of the grippers is arranged so as to be movable in the closing direction.

7. An apparatus according to claim 1, wherein the pairs of grippers each have one half of the grippers which is non-movable in the closing direction and one half of the grippers which is movable in the closing direction, and the two pairs of grippers are coupled to the control rocker such that during the opening and closing of the respective pair of grippers, the control rocker performs a movement in the same direction as the opening and closing movement of the movable half of the grippers in the region of the coupling point of the respective pair of grippers.

8. An apparatus according to claim 7, wherein the two pairs of grippers are each coupled to the control rocker by a single connecting rod.

9. An apparatus according to claim 1, wherein the rocker drive transmits actuating forces both in a loading direction and in a releasing direction to generate the reciprocating movement of the control end of the control rocker.

10. An apparatus according to claim 1, wherein the control rocker is connected by way of a connecting rod to a component that is fixed with respect to the apparatus.

11. An apparatus according to claim 1, wherein all force-introduction points into the control rocker are situated in a plane which is at a right angle to a pivot axis of the control rocker, such that the control rocker is free of torsional moment during operation.

12. An apparatus according to claim 11, wherein the plane in which the force-introduction points are situated extends through the longitudinal axis of a semi-finished material to be advanced by the apparatus during operation.

13. An apparatus for intermittently supplying a semi-finished material in the form of a band or a wire to a press, the apparatus comprising:

a pair of displacement grippers, running forwards and backwards during operation, for advancing the semi-finished material in an advancing phase, a stationary pair of clamping grippers for holding the semi-finished material in a fixed manner in a non-advancing phase, and a control rocker with a rocker drive coupled to one control end of the control rocker, wherein the pair of displacement grippers and the pair of clamping grippers are coupled mechanically to the control rocker such that during operation, the two pairs of grippers open and close in an alternating manner by reciprocating the control end of the control rocker with the rocker drive to alternately advance and hold the semi-finished material in a fixed manner, wherein the control rocker and the two pairs of grippers are arranged and coupled to one another such that without a force exerted by the rocker drive upon the control end of the control rocker, the two pairs of grippers are maintained in a closed position, wherein the two pairs of grippers are coupled to the control rocker at coupling points spaced apart from one another as viewed in a direction transverse to the control rocker, and a coupling point of the pair of displacement grippers to the control rocker is situated centrally between the coupling point of the pair of clamping grippers and the control end of the control rocker, wherein one or more pre-stressed spring elements, the spring elements being compression springs and/or tensile springs, engage on the control rocker, such that a closing of the pairs of grippers is assisted by the spring force of the one or more spring elements, and wherein a force-engagement point of the spring element or, in the case of a plurality of spring elements, the resulting force-engagement point is situated centrally in the region between the two coupling points of the pairs of grippers.

14. An apparatus for intermittently supplying a semi-finished material in the form of a band or a wire to a press, the apparatus comprising:

a pair of displacement grippers, running forwards and backwards during operation, for advancing the semi-finished material in an advancing phase, a stationary pair of clamping grippers for holding the semi-finished material in a fixed manner in a non-advancing phase, and a control rocker with a rocker drive coupled to one control end of the control rocker, wherein the pair of displacement grippers and the pair of clamping grippers are coupled mechanically to the control rocker such that during operation, the two pairs of grippers open and close in an alternating manner by reciprocating the control end of the control rocker with the rocker drive to alternately advance and hold the semi-finished material in a fixed manner, wherein the control rocker and the two pairs of grippers are arranged and coupled to one another such that in the absence of a force exerted by the rocker drive upon the control end of the control rocker the two pairs of grippers are maintained in a closed position, wherein the two pairs of grippers are arranged with respect to the control rocker to open and close in the alternating manner during operation by an upward and downward movement of the control end of the control rocker, and wherein the two pairs of grippers each have one half of the grippers which is non-movable in the closing direction and one half of the grippers which is movable in the closing direction, and the two pairs of grippers are coupled to the control rocker in such a way that during the opening and closing of the respective pair of grippers the control rocker performs a movement in the same direction as the opening and closing movement of the movable half of the grippers in the region of the coupling point of the respective pair of grippers.

15. An apparatus for intermittently supplying a semi-finished material in the form of a band or a wire to a press, the apparatus comprising:

a pair of displacement grippers, running forwards and backwards during operation, for advancing the semi-finished material in an advancing phase, a stationary pair of clamping grippers for holding the semi-finished material in a fixed manner in a non-advancing phase, and a control rocker with a rocker drive coupled to one control end of the control rocker, wherein the pair of displacement grippers and the pair of clamping grippers are coupled mechanically to the control rocker such that during operation, the two pairs of grippers open and close in an alternating manner by reciprocating the control end of the control rocker with the rocker drive to alternately advance and hold the semi-finished material in a fixed manner, wherein the control rocker and the two pairs of grippers are arranged and coupled to one another such that without a force exerted by the rocker drive upon the control end of the control rocker the two pairs of grippers are maintained in a closed position, wherein all force-introduction points into the control rocker, or in the case of a plurality of introduction points for the same force the respective resulting force-introduction points, are situated in a plane which is at a right angle to a pivot axis of the control rocker, such that the control rocker is free of torsional moment during operation, and wherein the plane in which the force-introduction points are situated extends through the longitudinal axis of a semi-finished material to be advanced by the apparatus during operation.

16. An apparatus for intermittently supplying a semi-finished material in the form of a band or a wire to a press, the apparatus comprising:

a pair of displacement grippers, running forwards and backwards during operation, for advancing the semi-finished material in an advancing phase, a stationary pair of clamping grippers for holding the semi-finished material in a fixed manner in a non-advancing phase, and a control rocker with a rocker drive coupled to one control end of the control rocker, wherein the pair of displacement grippers and the pair of clamping grippers are coupled mechanically to the control rocker such that during operation, the two pairs of grippers open and close in an alternating manner by reciprocating the control end of the control rocker with the rocker drive to alternately advance and hold the semi-finished material in a fixed manner, wherein the control rocker and the two pairs of grippers are arranged and coupled to one another such that in the absence of a force exerted by the rocker drive upon the control end of the control rocker the two pairs of grippers are maintained in a closed position, wherein the two pairs of grippers are coupled to the control rocker at coupling points spaced apart from one another as viewed in a direction transverse to of the control rocker, and the coupling point of the pair of displacement grippers to the control rocker is situated centrally between the coupling point of the pair of clamping grippers and the control end of the control rocker, wherein the two pairs of grippers are arranged with respect to the control rocker to open and close in the alternating manner during operation by an upward and downward movement of the control end of the control rocker, wherein one or more pre-stressed spring elements, the spring elements being compression springs and/or tensile springs, engage on the control rocker such that a closing of the pairs of grippers is assisted by the spring force of the said spring elements, wherein a force-engagement point of the spring element or, in the case of a plurality of spring elements, a resulting force-engagement point is situated centrally in the region between the two coupling points of the pairs of grippers, wherein the two pairs of grippers each have an upper half and a lower half which are movable towards each other in order to close the pairs of grippers and are movable away from each other in order to open the pairs of grippers, wherein the lower half of the grippers is designed so as to be non-movable in the closing direction and the upper half of the grippers is designed so as to be movable in the closing direction, wherein the pairs of grippers are coupled to the control rocker such that during the opening and closing of the respective pair of grippers the control rocker performs a movement in the same direction as the opening and closing movement of the movable half of the grippers in the region of the coupling point of the respective pair of grippers and wherein, in order to carry out the reciprocating movement of the control end of the control rocker, the apparatus has a rocker drive which can transmit actuating forces both in a loading direction and in a releasing direction, wherein the rocker drive is a connecting-rod or eccentric drive.

17. An apparatus according to claim 4, wherein the one or more spring elements are compression springs and/or tensile springs.

18. An apparatus according to claim 9, wherein the rocker driver is a connecting-rod or eccentric drive.

19. An apparatus according to claim 10, wherein a coupling point of the connecting rod on the control rocker coincides with the coupling point of one of the two pairs of grippers.

20. An apparatus according to claim 18, wherein the coupling point of the connecting rod on the control rocker coincides with the coupling point of the pair of grippers that is closest to the control end of the control rocker.

21. An apparatus according to claim 1, wherein the control rocker and the two pairs of grippers are arranged and coupled to one another with means for biasing each of the two pairs of grippers in the closed position such that each of the two pairs of grippers is maintained in the closed position in the absence of the supporting or actuating force exerted by the rocker drive upon the control end of the control rocker.

* * * * *

UNITED STATES PATENT AND TRADEMARK OFFICE

CERTIFICATE OF CORRECTION

PATENT NO. : 7,900,803 B2
APPLICATION NO. : 12/005658
DATED : March 8, 2011
INVENTOR(S) : Josef Thomas Hafner It is certified that error appears in the above-identified patent and that said Letters Patent is hereby corrected as shown below:

Column 9, Claim 15, line 43, insert a -- , -- after the word "rocker". Therefore, line 43 should read as follows:

"control end of the control rocker, the two pairs of"

Signed and Sealed this
Sixteenth Day of August, 2011

David J. Kappos

David J. Kappos
*Director of the United States Patent and Trademark Office*